US005438934A

United States Patent [19]

Goding

[11] Patent Number: 5,438,934

[45] Date of Patent: Aug. 8, 1995

[54] LIGHTWEIGHT, IMPROVED PERFORMANCE TRUCK

[75] Inventor: David J. Goding, Palos Park, Ill.

[73] Assignee: Amsted Industries Incorporated, Chicago, Ill.

[21] Appl. No.: 138,497

[22] Filed: Oct. 15, 1993

[51] Int. Cl.[6] ..... B61F 5/00

[52] U.S. Cl. ..... 105/199.3

[58] Field of Search ..... 105/199.1, 199.3, 226, 105/206.1

[56] References Cited

U.S. PATENT DOCUMENTS

| | | | |
|---|---|---|---|
| 630,358 | 8/1899 | King | 105/199.3 |
| 3,350,146 | 10/1967 | Williams | 105/199.3 |
| 4,108,080 | 6/1977 | Garner | 105/182 R |
| 5,048,427 | 9/1991 | Dumoulin | 105/199.3 |
| 5,109,776 | 5/1992 | Johnstone et al. | 105/199.3 |
| 5,138,954 | 8/1992 | Mulcahy | 105/199.3 |

FOREIGN PATENT DOCUMENTS

| | | | |
|---|---|---|---|
| 0162550 | 4/1955 | Australia | 105/199.3 |
| 1605132 | 7/1970 | Germany | 105/199.3 |
| 1525058 | 11/1989 | U.S.S.R. | 105/199.3 |

*Primary Examiner*—Mark T. Le

*Attorney, Agent, or Firm*—Edward J. Brosius; F. S. Gregorczyk; Thomas J. Schab

[57] ABSTRACT

A railcar suspension assembly at each end of a railcar eliminates the use of a car body bolster and allows payload forces to be carried at railcar side sills into a cross-extending box-like section. The section has bearing wear plates attached to it directly over the truck sideframes so that the forces pass directly downward, into the bearing assembly which is attached to the bolster ends. The forces then are transferred into a conventional sideframe. The loading path allows the bolster to be made with a lightweight midsection and conventional ends having friction shoe pockets.

8 Claims, 4 Drawing Sheets

LIGHTWEIGHT, IMPROVED PERFORMANCE TRUCK

FIELD OF THE INVENTION

This invention relates to a railcar suspension system and more particularly to a lightweight, three piece railcar truck.

BACKGROUND OF THE INVENTION

Conventional railcar suspension systems are well known in the industry and typically consist of a railcar body with body bolsters and three piece trucks. The car body bolster is located directly beneath the underside of the railcar and a car body bolster typically extends across the entire width of the railcar and has a male center plate bowl for transferring loads. The three-piece trucks are typically comprised of two longitudinally extending sideframes interconnected by a laterally extending truck bolster. The sideframes are generally positioned parallel to both the wheels and rails. The railcar body usually rests upon a truck located at each end of the railcar. The truck is typically connected to the railcar body bolster through a female truck bolster center plate bowl which mates with the corresponding male railcar body bolster center plate bowl.

In conventional freight cars (i.e., box cars, hopper cars, gondolas), the sides of railcars are structurally designed to carry the payload and the load path can be traced through the illustration shown in FIG. 1. For the sake of this discussion, the designation "P" will represent the payload of the railcar as well as the weight of the car and FIG. 1 illustrates that the load P is first distributed to an underlying railcar upper structure at 8, which laterally extends across the width of railcar 5. Upper structure 8 is typically constructed from a heavy structural component such as an I-beam, H-beam, or other channel shape which will statically and dynamically offer resistance to the deflection and bending moments caused by load P. From upper structure 8, the load is transferred into shear plate 12. Shear plate 12 is a structurally heavy plate which coexists with upper structure 8, longitudinally extending underneath the car, thereby providing a stable, extended base for railcar body bolster 20 to receive forces P therefrom. As seen from the illustration, body bolster 20 laterally extends across the width of railcar 5 in substantial coexistence with shear plate 12, supporting the railcar and receiving the payload P from railcar side rails 10, located at the distal ends of car 5. From here, the loads are transferred into truck bolster 35. The car body bolster 20 has a medial center plate bowl 25 in mating relationship with center plate bowl 30 on bolster 35 for effectuating the transfer of the load. Load P then travels outwardly from bolster center plate bowl 30 towards bolster ends 33,37, where support springs 45 absorb the downward forces and transfer them into spring seats 50. Referring now to FIG. 1A, it is shown that spring seat 50 is integrally cast as part of sideframe 55, load P will be transferred throughout entire sideframe 55, including each of the pedestal jaws 60. Each of the pedestal jaws hold the axles 65 and wheels 70 which support the truck, meaning that load P will be transferred from wheels 70 into rail contact point 75.

It is important to understand that the sideframes described above are considered conventional truss-like sideframes, and regardless of whether they are fabricated or cast, a conventional truss sideframe consists of a separate, top member 55C and a bottom member 55T. FIG. 3 illustrates that when the bolster 35 (not shown) is vertically loaded, downwardly acting forces P are transferred into spring plate 50 and the axles counteract these forces at the sideframe ends 33,37, causing top member 55C to undergo compression and the lower member 55T to undergo tension or stretching. Since each member 55C, 55T is individually handling a specific type of load, (tension or compression), the sideframe structure is effectively behaving like a truss; hence the "truss" designation for the sideframe.

With the conventional loading scheme described above, a car body bolster 20 and a truck bolster 35 are both required for transferring loading forces from the car, into the trucks. Since the car body and truck bolsters are mated together, they will exhibit equal and opposite forces against each other. Unlike the sideframes, the car body and truck bolsters can be generally characterized as a simply supported beam having an intermediate load at its respective center plate area, and a beam bending moment in the region of the intermediate load will be present. In addition, a shear load will also be present and it is generally constant between the ends of the respective bolster and the intermediate load. Truck bolster shear and moment diagrams are provided in FIGS. 1*c* and 1*d* respectfully, and it should be understood that the car body bolster shear and moment diagrams are exactly the same in magnitude as the truck bolster shear and moment diagrams, but opposite in sign and direction. When a car body rolls relative to each of the truck sideframes, (See FIG. 2) the sidebearings 80 will take all or part of the truck bolster load, thereby shifting the shear and bending moment conditions to those depicted in FIGS. 2*b* and 2*c*, respectfully.

The conventional loading scheme described by FIG. 1 has one disadvantage; the load path between sideframe and spring seats and the truck bolster center plate 30, parallels the load path between the carbody center plate 25 and to the car body side rails 10. The redundancy of transferring the load P from the outside rails 10 of railcar 5 to the center of the body bolster 20, and then back outside again through the truck bolster 35 to springs 45 adds suspension components which are unnecessary. Eliminating unnecessary load paths and related components will result with substantial production and manufacturing cost savings, as well as fuel savings from pulling a lighter railcar. However, when eliminating major structural components such as a car or truck bolster, it should be understood that the remaining suspension components will experience loading and performance characteristics unlike a conventionally loaded railcar and truck. Therefore, there are many underlying performance factors to be considered with a suspension system even when minor structural modifications are made.

In U.S. Pat. No. 4,030,424, an early car body and truck suspension system was provided that utilized a less redundant loading path from the car body to the truck. Even though the car body utilized a car body bolster, the weight of the car was supported by bearing assemblies which were attached to the top surface of the bolster. This arrangement eliminated the need for a typical heavy car body bolster since the load was carried directly over the sideframes. However, it was discovered that this design had several notable operating disadvantages when compared to the present invention. Primarily, this system required the use of bulky, nonconventional sideframe members which were rigidly attached to both a lower transom member, and to a lightweight truck bolster. Even though the light truck bolster was said to allow torsional twisting, the rigidly connected transom and bolster forced the truck into maintaining a very rigid H-shaped configuration which had a tendency to crack under truck warping conditions. Truck warping is an out-of-square condition necessary for when the truck experiences movements other than simple relative sideframe-to-sideframe twisting. This means that when the sideframes experience longitudinal movement with respect to each other, the rigidly connected transom was incapable of providing the strength for curving, causing the truck to crack the transom at the sideframe connection. The transom arrangement, while rigidizing the truck, restricts the truck from being able to experience out-of-plane warping or other conditions caused by track irregularities. Another disadvantage of this particular design was that the truck bolster did not utilize the conventional friction shoe damping method for controlling truck bolster oscillations. Rather, the bolster was damped by a shock absorber which effectively tied the bolster to the sideframe. Furthermore, the bolster of the '424 patent had a bracketed connection attached to it which engaged the sideframe during undue vertical movement. Moreover, the bracket prevents longitudinal or twisting movements of the truck bolster when longitudinal out-of-plane conditions are experienced. However, since the sideframes were not constructed as a continuously solid truss-like structure, this truck required the use of a permanently attached and transversely disposed transom plate between the sideframes as a means for maintaining structural integrity, or else the truck would never have been able to withstand the operating forces.

Another disadvantage of the '424 design was found in the cumbersome sideframe members. These fabricated sideframes consisted of several interconnected members with the top plate member acting as the base for the spring set group; this is exactly opposite from a conventional truss sideframe where the bottom member is used to carry the spring group load. With the '424 truck, this means that the forces from the bearing assemblies are first transferred into the top plates of the sideframes before being transferred through several structural components before reaching the bottom sideframe plate. This sideframe arrangement has unnecessary structural components which also have to be structurally larger than those of a conventional truss sideframe.

The railcar and truck suspension system developed in U.S. Pat. No. 5,138,954, utilized a conventional truss sideframe while eliminating the car body bolster. This design utilized a laterally longer bolster which supported the car body at the railcar side rails, however, since the bolster carried the entire load P outwardly of each of the sideframes, it was discovered that this loading arrangement had several disadvantages. The main disadvantage found was that a longer-than-standard bolster was required to span beyond the sideframes. This meant that special molds and patterns had to be developed providing the bolster with only one specific application. Furthermore, in relation to the outward loading, the bolster also required an increased cross-sectional area for resisting larger bending moments present at the spring seats, when compared to a conventional bolster. This means that the bolster midsection has to be deeper and substantially heavier in mass than conventional trucks. In relation to a deeper midsection, a taller sideframe is also required in order to allow the bolster to vertically travel during its damping functions. This means that standard sized sideframes could not be used. A final shortfall of this design was that the longer bolster also required a very low coefficient of friction sliding means between it and the outboard car body support since the moment arm caused by the outwardly loaded bolster more significantly resisted turning and curving movements.

SUMMARY OF THE INVENTION

It is the primary object of the present invention to provide a railcar suspension system which transfers the payload and weight of the railcar directly into the railcar truck without the use of railcar body bolster.

It is another object of the present invention to provide a lightweight railcar truck comprised of a pair of conventional truss-like sideframes of standard size and a lightweight bolster, the bolster having a lightweight design as a result of experiencing no intermediate vertical loads and which functions merely to maintain truck squareness and rigidity during out-of-plane conditions, thereby eliminating the need for a heavy, conventional type of truck bolster.

It is still another object of the present invention to provide a lightweight bolster which is damped by conventional friction shoe assemblies in order that squaring capabilities between the bolster and sideframe are maintained so that warping resistance is also maintained.

DETAILED DESCRIPTION OF THE PREFERRED EMBODIMENT

Figure 4:
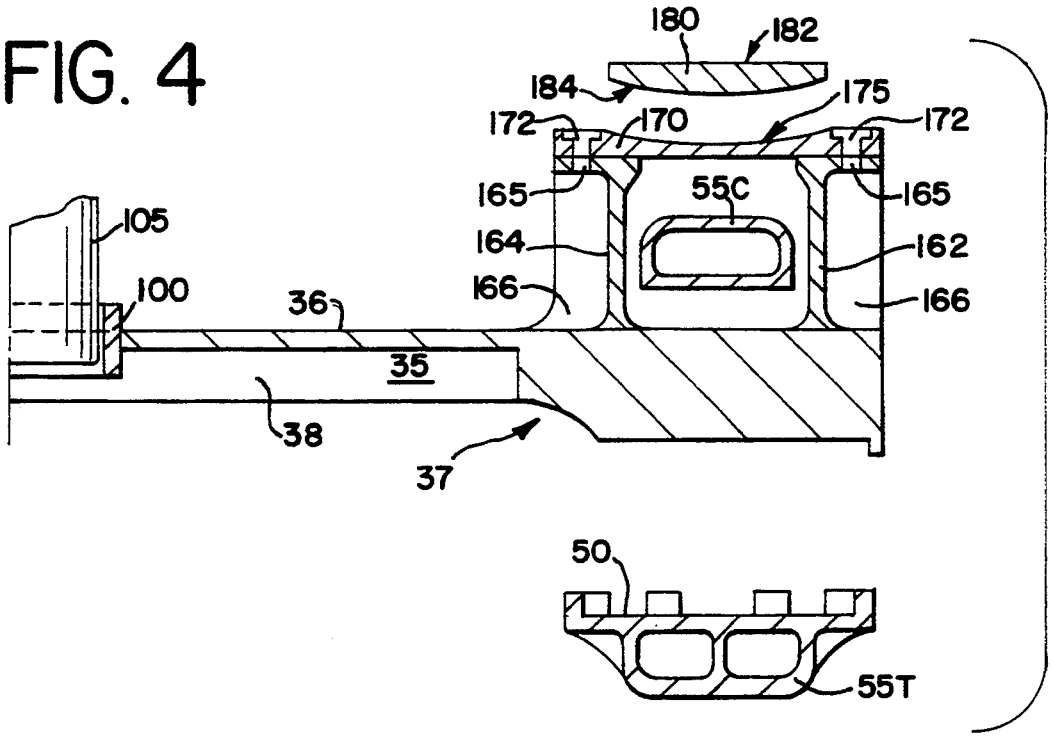
FIG. 4 is sideview in cross-section through the bolster and sideframe, showing the bearing assembly of the present invention.
Figure 5:
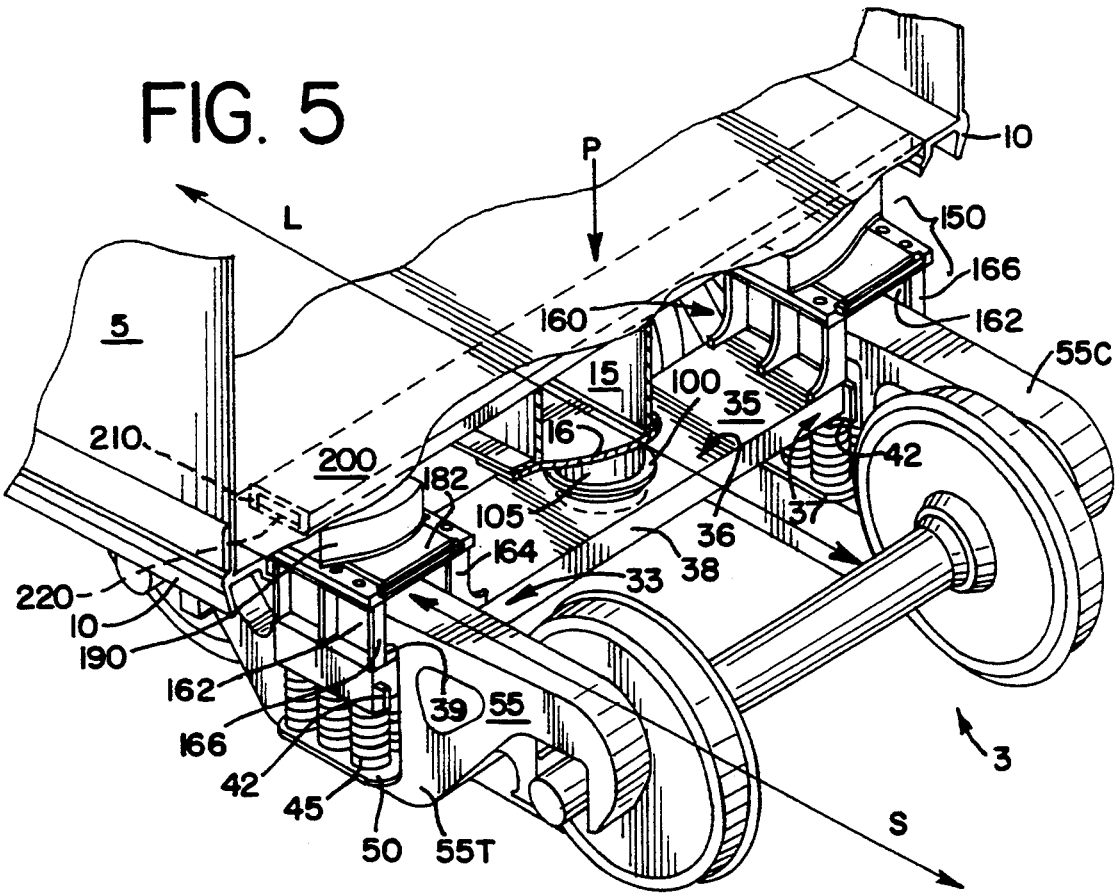
FIG. 5 is a perspective view of the truck assembly of the present invention.
Figure 6:
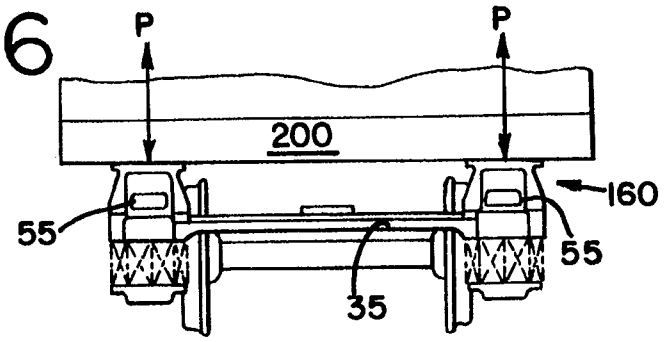
FIG. 6 is an end view of the truck assembly of the present invention showing the load path of the assembly.
Figure 6A:
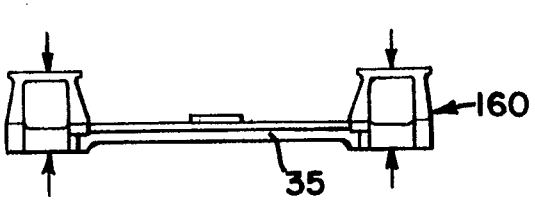
FIG. 6*a* is diagrammatic view of the truck bolster of the present invention when conventionally loaded.
Figure 6B:
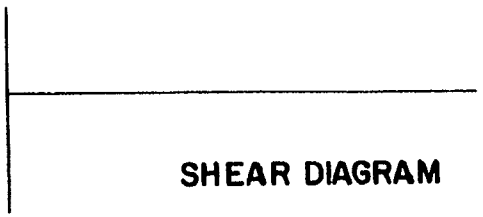
FIG. 6*b* is a shear diagram for the truck bolster of the present invention, indicating zero shear.
Figure 6C:
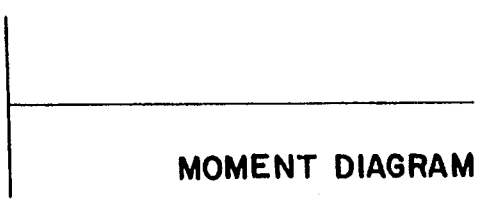
FIG. 6*c* is a moment diagram for the truck bolster of the present invention, indicating zero moments.

Referring now to FIGS. 4 and 5, the railcar of the present invention is shown and generally comprises a car body 5 provided with beams 200 on the underside thereof, trucks 3, and sidebearing assemblies 150 provided between car body 5 and trucks 3. Each of the sidebearing assemblies 150 includes a truck bolster bearing housing 160 and a car wear plate 190. Since the suspension systems of the railcar of the present invention are essentially identical at the front and rear ends of the railcar, only the suspension system at one end of the railcar is shown in FIG. 5, which will be described in greater detail. As seen in FIG. 5, car body 5 has a beam 200 laterally extending on the underside of car body 5, and spanning substantially the width of the rail body. A pair of railcar side rails 10 are attached to the sides of car body 5. The side rails 10 extend parallel to axis L of the railcar and run the entire longitudinal length of the rail body. The rails 10 are structural beams which form the lower structure of the car body sides and are designed to carry a payload P on the railcar and the weight of the car body. Each of the beams 200 spans from side rail 10 to side rail 10 and is in the form of a box-like section, which comprises a C-shaped channel welded along the channel flanges thereof to a plate structure and forms an open structure. Attached at the midsection of beam 200 is inverted U-shaped stub center sill 15. This center sill is stubbed, meaning it does not longitudinally extend the entire underside of car body 5. Attached across the opening of center sill 15 is plate 16 which has central pin 105 extending downwardly therefrom for insertion into inside bolster column 100. The pin 105 and column 100 transfer lateral loads from car body 5 to truck 3. Laterally spaced from axis L are car wear plates 190, which are also attached to beam 200 and they are disposed directly over the longitudinal centerline "S" of each of the sideframes 55. The car wear plates 190 are in communication with the bearing housings 160, thereby transferring the payload of car 5 into truck 3, as will be explained in greater detail later.

Figure 1:
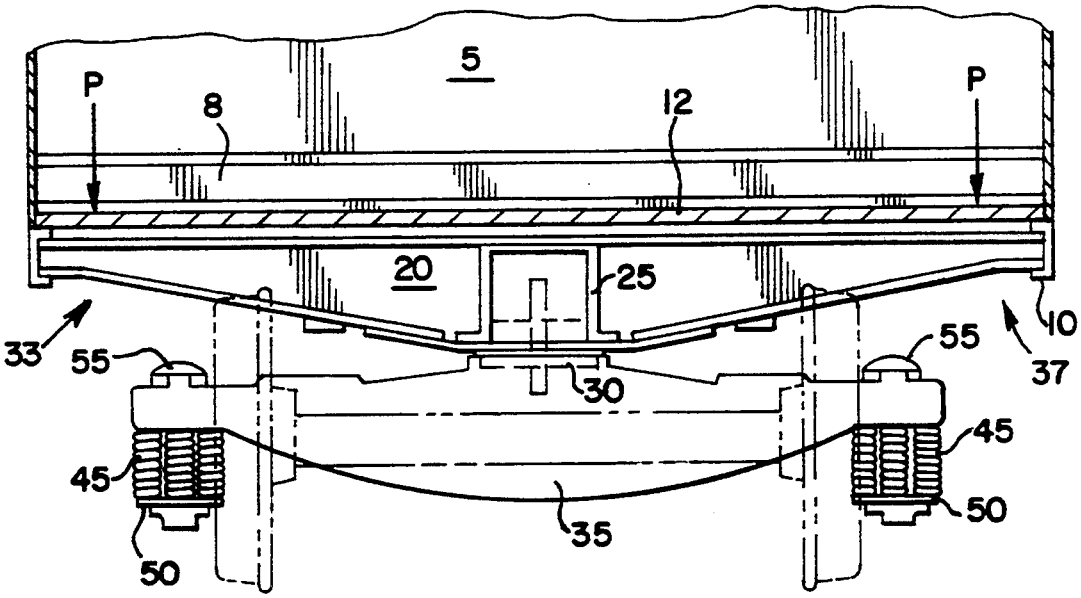
FIG. 1 PRIOR ART
FIG. 1 is an cross-sectional end view of a conventional railcar truck assembly showing the load path of the assembly.
Figure 1A:
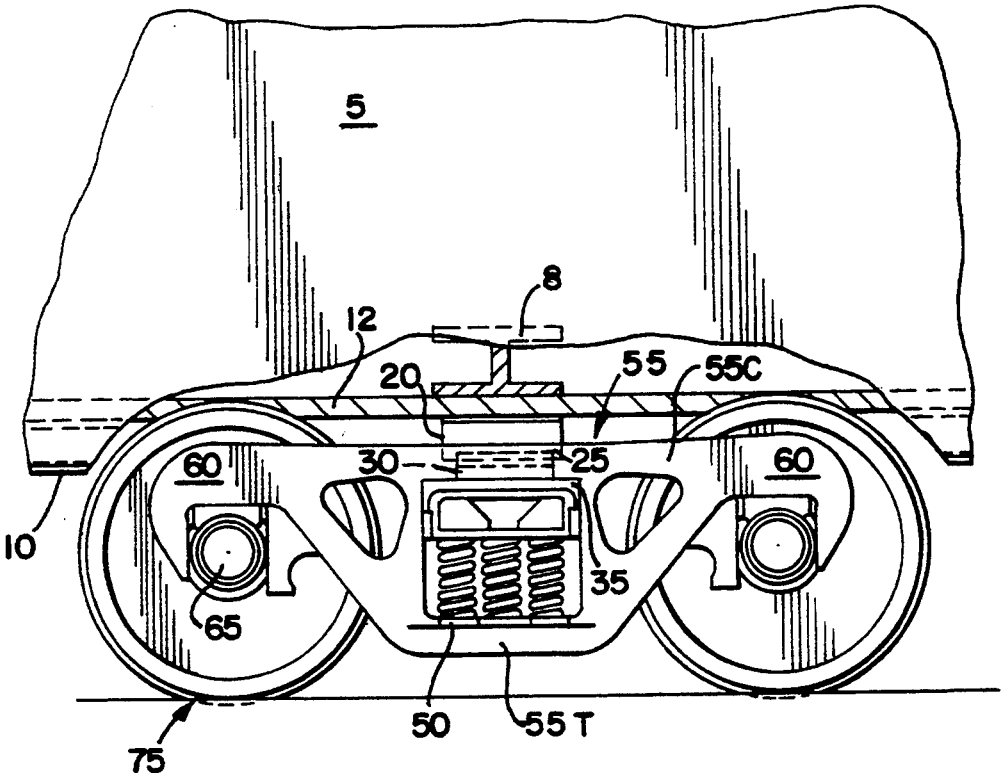
FIG. 1A PRIOR ART
FIG. 1*a* is a side view of the truck shown in FIG. 1.
Figure 2:
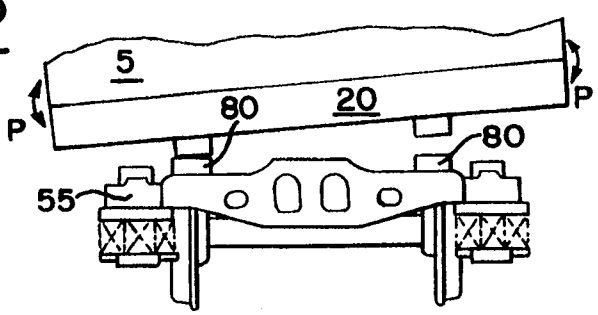
FIG. 2 PRIOR ART
FIG. 2 is an end view of a conventional truck assembly showing the truck load path during a lateral car body roll.
Figure 2A:
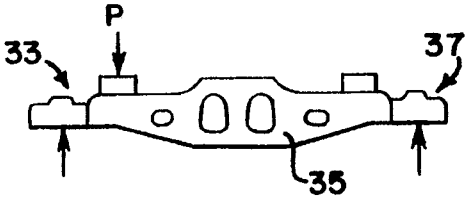
FIG. 2A PRIOR ART
FIG. 2*a* is a diagrammatic view of the truck bolster of FIG. 2 during lateral rolling.
Figure 2B:
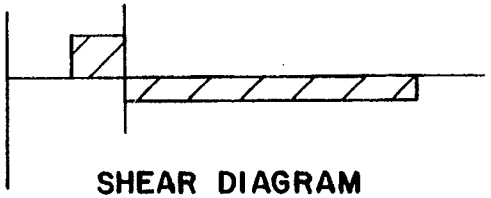
FIG. 2B PRIOR ART
FIG. 2*b* is a shear diagram for the conventional bolster of FIG. 2.
Figure 2C:
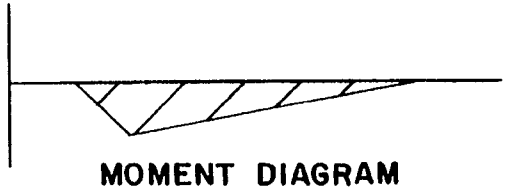
FIG. 2C PRIOR ART
FIG. 2*c* is a moment diagram for the conventional bolster of FIG. 2.
Figure 1B:
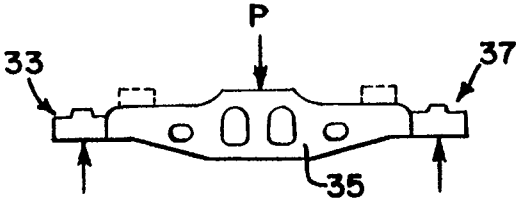
FIG. 1B PRIOR ART
FIG. 1*b* is a diagrammatic view of the conventionally loaded truck bolster of FIG. 1.
Figure 1C:
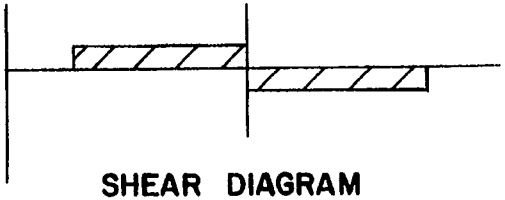
FIG. 1C PRIOR ART
FIG. 1*c* is a shear diagram for a conventionally loaded truck bolster.
Figure 1D:
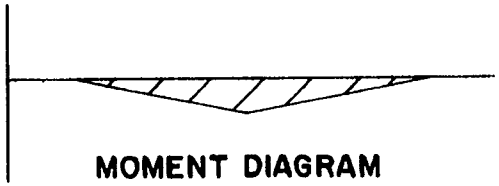
FIG. 1D PRIOR ART
FIG. 1*d* is moment diagram for a conventionally loaded truck bolster.
Figure 3:
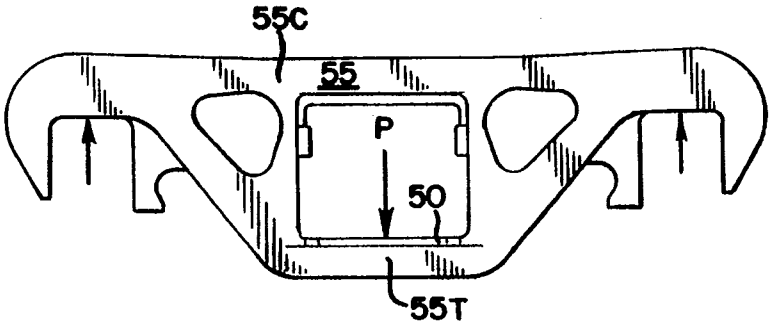
FIG. 3 is a side view of conventional truss-type sideframe showing a simple loading diagram of the forces acting on a sideframe.
Figure 7:
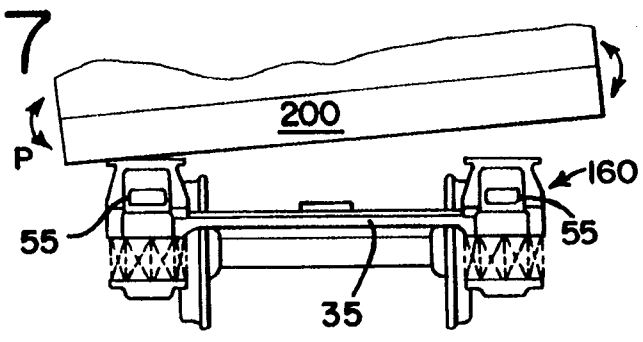
FIG. 7 is an end view of the truck of the present invention showing the truck load path during a lateral car body roll.
Figure 7A:
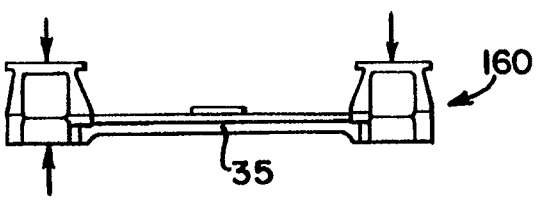
FIG. 7*a* is a diagrammatic view of the bolster of FIG. 7 during lateral rolling.
Figure 7B:
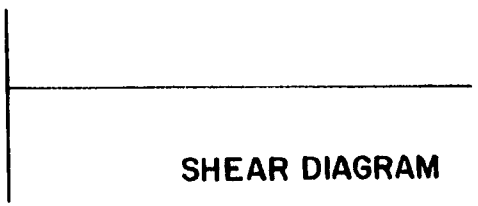
FIG. 7*b* is a shear diagram for the truck bolster of FIG. 7.
Figure 7C:
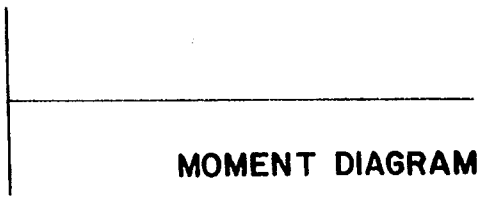
FIG. 7*c* is a moment diagram for the truck bolster of FIG. 7.

The truck bolster 35 preferably is a lightweight casting comprising a top wall 36 and two vertical side walls 38 interconnected together, with each of the three walls remaining at a constant dimension across the full length of the transversely extending bolster. It is to be noted that bolster 35 is a lightweight bolster and is not constructed with a connecting bottom wall, meaning that the bolster has an open section in the shape of a channel in the area extending between spring sets 45. Bolster ends 33,37 are constructed with conventional solid bolster sections that contain friction shoe pockets 39 formed into each of the bolster sidewalls 38. The pockets receive friction shoes (not shown) which damp vertical bolster oscillations. The friction shoe pockets and shoes of are incorporated because they add squaring capabilities between the bolster and the sideframe columns. Maintaining squaring capabilities is another important feature of this invention because it enables a three-piece truck to resist warping, which improves curving characteristics and high speed performance. Similarly, since the lightweight bolster and the sideframes form a generally flexible, H-shaped configuration, the single connection between the sideframes allows longitudinal movement of the sideframes with respect to each other so as to permutate the H-shaped configuration. Bolster gibs 42, are located on each of the bolster vertical walls 38, and on each side of sideframe 55, generally outside of each friction shoe pocket 39, in order to prevent bolster 35 from laterally moving more than a predetermined lateral distance. Each bolster end 33,37 rests upon support springs 45, and any vertical loads transferred into bolster ends 33,37 from car body 5 are transferred directly into springs plates 50, since car body 5 is supported directly over sideframes 55, rather than at the center plate area as with a conventional truck. Carrying the payload directly over the sideframe centerline is an important feature affecting the rest of the suspension system and it allows the bolster to be substantially lighter in structure such as the uncomplicated and lightweight C-shaped channel section bolster 35 illustrated in FIGS. 2 and 5. This point is graphically understood by viewing FIGS. 7*a* and 7*b*, which indicate that bolster 35 has no shear or moment forces acting upon it. The resultant reduction in weight and production costs of a lightweight bolster is another important feature of this invention. As previously described, prior art conventional trucks carried the weight of the railcar at the bolster center plate, requiring the bolster to be structurally heavier and capable of handling the bending moments caused by the intermediate loading on the bolster. (See FIG. 2*c*) Since bolster 35 carries no intermediate vertical loads, the bolster does not require the same load-carrying capabilities. It is important to understand that the bolster of the present invention only carries substantial vertical loads at the sideframe areas. The present bolster only maintains contact with the car body at a central column 100 so as to establish a center of rotation between the truck and the car body for transmitting horizontal forces. The horizontal forces are typically those which result from the turning or pivoting of the car body on the truck and are substantially smaller than any vertical loads, and as mentioned earlier, car body 5 has a central-pin 105 which inserts inside column 100 for completing the pivoting assembly.

Transferring the payload and weight of the railcar to the truck is a function of the bearing assembly, generally shown at 150 and comprising bearing housing 160 mounted on each bolster end 33,37, and car wear plate 190, mounted to the underneath side of car body 5. As illustrated, bearing housing 160 straddles sideframe 55 rather than resting upon the top surface of sideframe 55, so that forces are transferred directly into support springs 45. Spring plate 50 further distributes the forces directly into the entire lower tension member 55T for final distribution into each of truck axles. Bearing housing 160 is an inverted U-shaped fabrication formed by a pair support walls 162, 164 preferably welded to bolster 35, although they can be bolted. Each of the support walls is coextensive with the width of bolster top member 36, and interconnected by a top wall 170, which is also coextensive with the width of top member 36. In FIG. 4, a cross-sectional side view of bearing housing 160 shows that support walls 162, 164 are bolted to top wall 170. More specifically, top wall 170 and each wall 162,164 have respective vertically aligned throughbores 172 and 165 for accepting bolts (not shown) that connect the roof to the walls. To avoid interfering with the bearing pad 180, it is preferable that roof top surface be provided with an annular depression around each bolt throughbore for countersinking the bolt heads. If desired, the support wall throughbores 165 can be internally threaded as an alternative to using lock washers and nuts. The vertical height of each support wall 162,164 is such that there is sufficient clearance between each sideframe top member 55C and top wall 170 when the suspension system is operable through a full range of motions. Each support wall 162, 164 is structurally strengthened by reinforcing struts 166, which are arranged in an equally spaced relationship along bolster top wall 36. As seen in the figure, outboard support walls 162 are positioned slightly inward from bolster end 33 such that when the outboard reinforcing struts 166 are welded to top bolster wall 36, they are in vertical alignment with the edge of each of the bolster ends so that they do not overhang the bolster ends. The inboard and outboard support wall edges 163,165 are also generally in vertical alignment with bolster gibs 42 so that bearing housing 160 does not further limit the lateral movement bolster 35 is allowed to travel between gibs.

Top wall 170 of bearing housing 160 is provided with a concave, cylindrical recess 175 for receiving bearing pad 180. Bearing pad 180 has a planar top surface 182 in communication with wear plate 190, and convex bottom surface 184 is in mated relationship with concave recess 175, allowing bearing pad 180 to adjust to roll out-of-plane conditions like curving or rock-and-roll, as disclosed and claimed in U.S. Pat. No. 5,046,866, granted Sep. 10, 1991, assigned to the assignee of the present application and hereby incorporated into the present application by this reference. As illustrated, bearing pad 180 is centered over sideframe 55 such that bearing loads are generally directed downwardly over the longitudinal centerline S of sideframe 55, thereby eliminating the creation of any moment arm which would be formed on bolster 35 if the bearing load was carried inboard or outboard of sideframe centerline S. This point is again graphically represented by viewing FIGS. *7a* and *7b*, where it is shown that bolster 35 has no shear forces or bending moments acting upon it.

FIG. 5 shows that the underside of car body 5 includes wear plate 190 in contact with bearing pad 180 of truck bolster bearing assembly 150 and it is to be understood that wear plate 190 is very large when compared to the size of bearing pad 180 and bolster bearing assembly 150, both in length and width. Providing a large wear plate ensures that constant contact with bearing pad 180 will be maintained through the full range of truck rotation without concern for bearing pad 180 popping out of concave recess 175 during extreme rocking or bouncing conditions. In addition, the flexure in the bolster allows the truck to permutate from the H-shaped configuration it normally maintains, thereby providing additional ensurances that pad 180 will remain in place. This system also means that typically used bearing pad retaining means do not have to be incorporated into the bearing assembly.

Wear plate 190 is not made from a low coefficient of friction material because bolster 35 takes no vertical loads. This means that whenever a lateral force acts upon car body 5 and pivots it at column 100, there will be no vertical forces acting on the bolster to make car body rotation around column 100 more difficult. Wear plate 190 can be made from an material where the coefficient of friction is about 0.10 to about 0.20.

We claim:

1. A combination of a railcar suspension and a railcar having a railcar body, said railcar suspension system being located on an underside of said railcar body which has a front end, a rear end, a pair of sides and a longitudinal axis, each of said sides including a side rail longitudinally extending between the ends of said railcar body, said railcar carrying a payload and being free of a body bolster, the combination further comprising:

a beam at each said railcar body end, each said beam extending between said railcar body side rails;

a railcar truck disposed at each said railcar body end and in association with a respective said beam, each said truck comprised of a pair of longitudinally spaced sideframes having a top compression member, a bottom tension member, and a central opening therebetween, each of said sideframes supported by a pair of longitudinally spaced wheeled axles transversing said sideframes, said bottom tension member including a horizontally disposed plate attached to said bottom tension member at said central opening for receiving a spring set;

a single connection laterally extending between said respective sideframes, said single connection and said sideframes forming a generally flexible, H-shaped configuration wherein said single connection allows longitudinal movement of said sideframes with respect to each other so as to permutate said H-shaped configuration, said single connection comprising a bolster of a relatively light weight, said bolster extending into each of said sideframe central openings and free of means for restraining vertical bolster movement, said bolster having a first end, a second end, and a midsection, each of said bolster ends generally constructed as a relatively solid component, each of said bolster ends supported by a respective said spring set and having opposed friction shoe pockets, said bolster midsection constructed as a relatively open component;

first and second sidebearing assemblies located on said bolster ends, each said sidebearing assembly comprised of a railcar body wear plate and a bolster bearing housing, said first sidebearing assembly attached to and coextensive with said first bolster end and said second sidebearing assembly attached to and coextensive with said second bolster end, each of said sidebearing assemblies free of rigid connections with said sideframes wherein each said bearing housing includes a longitudinally disposed passage having a passage width such that a respective said sideframe top compression member longitudinally extends through said bearing passage without contacting said bearing housing, each said bearing housing also having a recessed channel for holding a bearing pad, said bearing pad having a convex lower surface and a planar upper surface, said convex lower surface in communication with said bearing housing recessed channel and said planar upper surface in communication with said railcar body wear plate, said car wear plate attached to said beam above said bearing housing, whereby said railcar payload is first passed into each said railcar body side rails, then into each said railcar body beam and then into each respective railcar body wear plate before directly entering into each said bearing assembly bearing pads, then through each respective said bearing housing before passing into each of said bolster ends and each of said respective spring sets, wherein said payload is finally transferred into each respective said sideframe bottom tension member spring plate and each respective said sideframe of said truck.

2. The combination of claim 1 wherein each of said bearing assembly recesses have a cylindrical concave profile and each of said bearing pad lower surfaces have a cylindrical convex profile, each of said bearing pads capable of transverse rolling movement with respect to said longitudinal axis.

3. The combination of claim 2 wherein said bearing assembly is removably fixed to said bolster.

4. The combination of claim 3 further including means for laterally preventing said bolster from moving with respect to each of said sideframes, said means attached to each of said bolster ends such that said bolster is allowed to laterally travel an extent substantially equal to said width of said bearing housing passage.

5. A railcar truck of relatively light weight for mounting on an underside of a railcar body for carrying a railcar payload, said railcar body having a front end, a rear end, a pair of sides and a longitudinal axis, each of said sides including a side rail longitudinally extending between the ends of said railcar body, said railcar body free of a body bolster and having a front and a rear beam, said front beam extending between said side rails at said railcar body front end and said rear beam extending between said side rails at said railcar body rear end, said truck comprising:

a pair of longitudinally spaced sideframes having a top compression member, a bottom tension member, and a central opening therebetween, each of said sideframes supported by a pair of longitudinally spaced wheeled axles transversing said sideframes and further including a horizontally disposed plate attached to said bottom tension member at said central opening for receiving a respective spring set;

a single connection between said respective sideframes, said single connection and said sideframes forming a generally flexible, H-shaped configuration wherein said single connection allows longitudinal movement of said sideframes with respect to each other so as to permutate said H-shaped configuration, said single, connection comprising a bolster of relatively light weight, which said bolster transversely extends into each of said sideframe central openings, said lightweight bolster having a first end, a second end, and a midsection, each of said bolster ends generally constructed as a relatively solid component and said midsection constructed as a relatively open component, each of said bolster ends supported by a respective sideframe said spring set and including opposed friction shoe pockets, said bolster free of retainment means for preventing undue vertical movement of said bolster;

said bolster including a first sidebearing assembly attached to and coextensive with said first bolster end and a second sidebearing assembly attached to and coextensive with said second bolster end, each said sidebearing assembly comprised of a railcar body wear plate and a bolster bearing housing, each of said sidebearing assemblies free of rigid connections with said sideframes wherein each said bearing housing includes a longitudinally disposed passage having a passage width such that said a respective said sideframe top compression member longitudinally extends through said bearing passage without contacting said bearing housing, each said bearing housing also having a recessed channel for holding a bearing pad, said bearing pad having a convex lower surface and a planar upper surface, said lower convex surface in communication with said bearing housing recessed channel and said planar upper surface in communication with said railcar body beam, which said railcar body wear plate is attached to said beam, whereby said railcar payload is passed into each said railcar body side rails, then into each said railcar body beam and then into each respective railcar body wear plate before directly entering into each of said bearing assembly bearing pads, then through each respective said bearing housing before passing into each said bolster ends and each respective said spring set supporting said bolster, wherein said payload is finally transferred into said sideframe bottom tension member spring plates and said sideframes of said truck.

6. The lightweight truck of claim 5 wherein said midsection of said bolster is free from direct vertical loading, which said lightweight bolster functions to merely maintain a squareness and rigidity of said truck, thereby eliminating the need for a conventional truck bolster which has a generally closed and structurally reinforced midsection.

7. The lightweight truck of claim 6 wherein said friction shoe pockets are provided for accommodating friction shoe assemblies for maintaining said truck squareness between said bolster and said sideframes, thereby maintaining a capability of said truck to resist truck warping.

8. The lightweight truck of claim 7 wherein said lightweight bolster midsection further includes a first vertical sidewall and a second vertical sidewall, each said vertical sidewall having a constant vertical dimension across said midsection and each said vertical dimension equal in extent, said midsection free of a bottom wall.

* * * * *